US008846288B2

(12) United States Patent
Ochiai et al.

(10) Patent No.: US 8,846,288 B2
(45) Date of Patent: Sep. 30, 2014

(54) EXTERNAL ADDITIVE FOR TONER AND METHOD FOR PRODUCING THE SAME

(75) Inventors: Kazuo Ochiai, Kouriyama (JP); Shinji Tanabe, Tokyo (JP); Naoaki Narishige, Ichikawa (JP)

(73) Assignee: Nippon Chemical Industrial Co., Ltd., Tokyo (JP)

( * ) Notice: Subject to any disclaimer, the term of this patent is extended or adjusted under 35 U.S.C. 154(b) by 808 days.

(21) Appl. No.: 12/162,652

(22) PCT Filed: Jan. 25, 2007

(86) PCT No.: PCT/JP2007/051145

§ 371 (c)(1),
(2), (4) Date: Oct. 3, 2008

(87) PCT Pub. No.: WO2007/086450

PCT Pub. Date: Aug. 2, 2007

(65) Prior Publication Data

US 2009/0117385 A1 May 7, 2009

(30) Foreign Application Priority Data

Jan. 30, 2006 (JP) ..... 2006-020181

(51) Int. Cl.
*G03G 13/08* (2006.01)
*G03G 9/00* (2006.01)
*G03G 9/097* (2006.01)

(52) U.S. Cl.
CPC ..... *G03G 9/09708* (2013.01)
USPC ..... 430/123.51; 430/106.3

(58) Field of Classification Search
USPC ..... 252/182.33; 430/108.23, 110.2, 127.15, 430/123.51, 106.3
See application file for complete search history.

(56) References Cited

U.S. PATENT DOCUMENTS

| | | | | |
|---|---|---|---|---|
| 5,561,019 | A | 10/1996 | Yuasa et al. | |
| 5,702,858 | A | 12/1997 | Yuasa et al. | |
| 6,383,703 | B1 | 5/2002 | Asano et al. | |
| 7,378,207 | B2 * | 5/2008 | Oyama et al. | 430/108.23 |
| 2002/0115008 | A1 | 8/2002 | Suzuki et al. | |
| 2004/0197693 | A1 | 10/2004 | Ninomiya et al. | |

FOREIGN PATENT DOCUMENTS

| | | | |
|---|---|---|---|
| JP | 5-330824 | A | 12/1993 |
| JP | 07-295282 | * | 11/1995 |
| JP | 7-295282 | A | 11/1995 |
| JP | 7-306542 | A | 11/1995 |
| JP | 7-306543 | A | 11/1995 |
| JP | 2001-66820 | A | 3/2001 |
| JP | 2002-107999 | A | 10/2002 |
| JP | 2004-26641 | A | 1/2004 |
| JP | 2004-287197 | A | 10/2004 |
| JP | 2005-55609 | A | 3/2005 |
| JP | 2005-289668 | A | 10/2005 |
| JP | 2005-306691 | A | 11/2005 |
| JP | 2005-316225 | A | 11/2005 |
| JP | 2005-316226 | A | 11/2005 |

OTHER PUBLICATIONS

English Language Abstract of JP 2005-55609 A.
English Language Abstract of JP 7-295282 A.
English Language Abstract of JP 2005-316226 A.
English Language Abstract of JP 2005-316225 A.
English Language Abstract of JP 2004-287197 A.
English Language Abstract of JP 2001-66820 A.
English Language Abstract of JP 2004-26641 A.
English Language Abstract of JP 2005-306691 A.
English Language Abstract of JP 5-330824 A.
English Language Abstract of JP 2005-289668 A.
English Language Abstract of JP 7-306542 A.
English Language Abstract of JP 7-306543 A.
English Language Abstract of JP 2002-107999 A.
U.S. Appl. No. 12/652,653 to Ochiai et al., I.A. filed Jan. 25, 2007 and entitled "External Additive for Toner and Method for Producing the Same".
U.S. Appl. No. 12/162,653 to Ochiai et al., I.A. filed Jan. 25, 2007 and entitled "External Additive for Toner and Method for Producing the Same".

* cited by examiner

*Primary Examiner* — Monique Peets
(74) *Attorney, Agent, or Firm* — Greenblum & Bernstein, P.L.C.

(57) ABSTRACT

When being blended in a toner, a barium titanate external additive for toner enhances, in particular, the toner fluidity, electrical properties, and other relevant performance; concurrently achieves high image density and reduced background fog in a printer using the toner; and further reduces image defects, such as void, fading, and the like. An industrially advantageous producing method of the barium titanate external additive for toner is also provided. The external additive for toner of the present invention includes spherical barium titanate having a specific gravity of 5.6 g/ml or less.

7 Claims, 1 Drawing Sheet

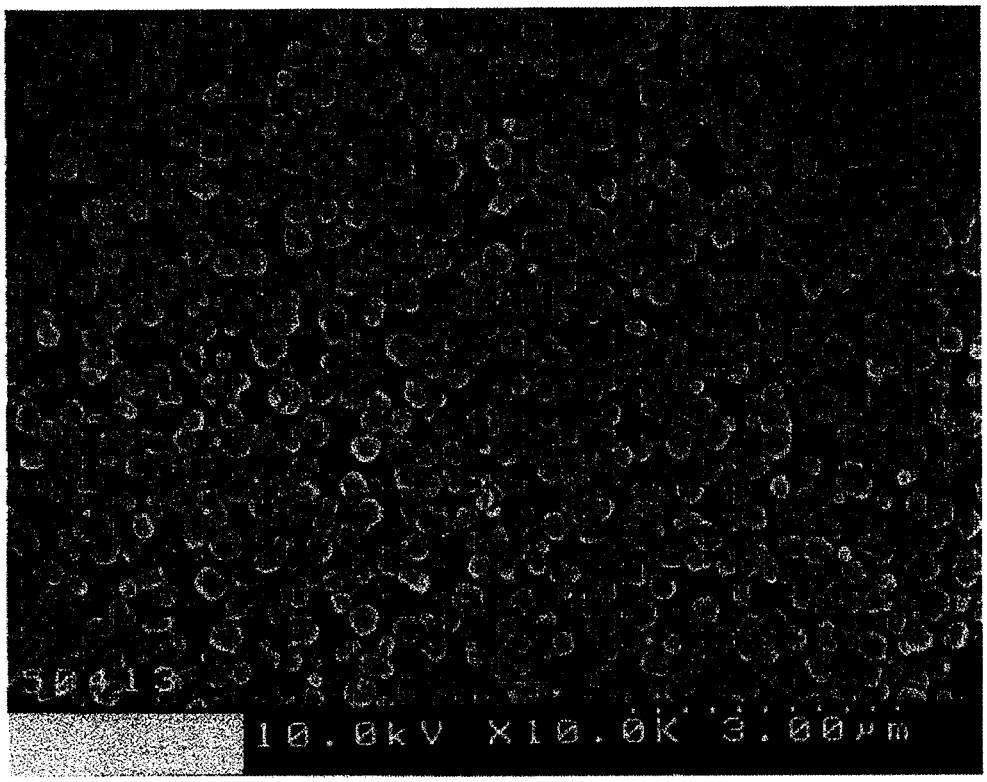
10.0kV X10.0K 3.00μm

EXTERNAL ADDITIVE FOR TONER AND METHOD FOR PRODUCING THE SAME

BACKGROUND OF THE INVENTION

1. Field of the Invention

The present invention relates to a barium titanate external additive for toner and a method for producing the same.

2. Description of Related Art

With increasing printer speed and improving image quality in recent years, it has been performed, in terms of enhancement of toner fluidity, electrical properties, and cleaning performance, that inorganic or organic external additives in fine powder form are adhered to a toner surface so as to enhance the toner fluidity.

It is proposed in addition, that barium titanate is used as the external additives. Proposed methods use, for example, barium titanate produced in an oxalate method and having an average particle size of 0.1 μm to 4 μm and a BET specific surface area of 0.5 $m^2/g$ to 20 $m^2/g$ (refer to Related Arts 1 to 3, for example); barium titanate produced in a liquid phase method and having a BET specific surface area of 0.5 $m^2/g$ to 5 $m^2/g$ (refer to Related Art 4, for example); and the like. It is desired, however, to develop barium titanate for external additives that can also meet further increasing printer speed and improving image quality.

[Related Art 1] Japanese Patent Laid-open Publication H7-306542

[Related Art 2] Japanese Patent Laid-open Publication H7-295282

[Related Art 3] Japanese Patent Laid-open Publication H7-306543

[Related Art 4] Japanese Patent Laid-open Publication 2002-107999

SUMMARY OF THE INVENTION

As a result of extensive research in order to address the above-described problems, the inventors of the present invention found that blending in a toner, spherical barium titanate having a specific gravity of a predetermined value or less, enhances the toner fluidity, electrical properties, and other relevant performance; concurrently achieves high image density and reduced background fog in a printer using the toner; and further reduces image defects, such as void, fading, and the like. Thereby, the inventors completed the present invention.

Specifically, the present invention is intended to provide a barium titanate external additive for toner that, when being blended in a toner, enhances, in particular, the toner fluidity, electrical properties, and other relevant performance; concurrently achieves high image density and reduced background fog in a printer using the toner; and further reduces image defects, such as void, fading, and the like. The present invention is also intended to provide an industrially advantageous producing method of the barium titanate external additive for toner.

The external additive for toner according to the present invention includes spherical barium titanate having a specific gravity of 5.6 g/ml or less.

The producing method of the external additive for toner according to the present invention includes a first process, in which titanium hydroxide, which is obtained from hydrolysis of titanium alkoxide by water, and a barium compound are reacted in a solvent containing water and alcohol; and a second process, in which the product obtained in the first process is heat-treated at a temperature of 400° C. to 1,000° C., so as to obtain spherical barium titanate.

BRIEF DESCRIPTION OF THE DRAWINGS

FIG. 1 is an electron microscope photograph illustrating a particle shape of barium titanate Sample 1-1.

DETAILED DESCRIPTION OF PREFERRED EMBODIMENTS

The present invention is explained below based on preferred embodiments. An external additive for toner according to the present invention includes spherical barium titanate having a specific gravity of 5.6 g/ml or less. The external additive having the above-described structure provides a toner with excellent fluidity, electrical properties, and other relevant performance; concurrently achieves high image density and reduced background fog in a printer using the toner; and further reduces image defects, such as void, fading, and the like.

The spherical barium titanate in the present invention represents that, when the barium titanate is used as the external additive for toner in a form of monodispersed primary particles, the primary particles of barium titanium themselves have a spherical shape; and that, when the barium titanate is used as the external additive for toner in a form of aggregates of fine primary particles, the aggregates themselves have a spherical shape.

In the present invention, the barium titanate having a spherical shape is used, which is represented as a sphericity of a range from 1.0 to 1.4, as defined below. In the present invention, it is particularly preferable that the spherical barium titanate have a perfect spherical shape. The sphericity of the spherical barium titanate is preferably in a range from 1.0 to 1.3, and particularly preferably from 1.0 to 1.25, thereby further enhancing the fluidity and other physical properties of a toner blended with the external additive.

In addition to the above-described sphericity range, surface roughness (defined below) of the spherical barium titanate is in a range from 1.0 to 1.4, preferably from 1.0 to 1.3, and more preferably from 1.0 to 1.25, thereby further enhancing the fluidity of the toner blended with the external additive and adhesion performance to toner resin.

Parameters used for the sphericity and surface roughness in the present invention are obtained from image analysis processing of 100 particles randomly sampled when samples are observed using an electron microscope at a magnification of 10,000 to 30,000 times. More specifically, the sphericity is represented as an average value of 100 particles obtained by Formula (1) below; and the surface roughness is represented as an average value of 100 particles obtained by Formula (2) below.

$$\text{Sphericity}=\text{Perfect circle area formed by a maximum diameter}/\text{Actual surface area} \quad (1)$$

$$\text{Surface roughness}=\text{Perfect circle area forming a boundary length}/\text{Actual surface area} \quad (2)$$

An image analyzing device used for the image analysis processing is not particularly limited. For instance, Luzex AP (Nireco Corporation) may be used. The closer a value of the sphericity is to 1, the closer the shape is to a perfect sphere. The closer a value of the surface roughness is to 1, the closer the shape is to a perfect sphere and the smoother a particle surface is.

In addition to that the external additive for toner according to the present invention is barium titanate having the above-described spherical shape, it is also an important structural requirement that the spherical barium titanate has a physical property of 5.6 g/ml or less in specific gravity, preferably 5.55 g/ml or less. More specifically, barium titanate produced in a regular method has a specific gravity of a range from 5.7 g/ml to 6.0 g/ml after calcination. However, the spherical barium titanate used in the present invention has a specific gravity of 5.6 g/ml or less, preferably 5.55 g/ml or less, and thus barium titanate having a lower specific gravity than a conventional barium titanate external additive is used. The range of specific gravity in the present invention is specified as above because, when the specific gravity exceeds 5.6 g/ml, the adhesion performance to toner particles declines, thus reducing the effects to provide a toner with excellent fluidity, electric properties, and other relevant performance. It is accordingly difficult to achieve high image density and reduced background fog in a printer using the toner, and to reduce image defects, such as void, fading, and the like. Since it is technically difficult to produce barium titanate having a specific gravity of less than 5.0 g/ml, it is particularly preferable to use barium titanate having a specific gravity of a range from 5.0 g/ml to 5.55 g/ml in the present invention.

Another preferable physical property of the spherical barium titanate that can be used as the external additive for toner of the present invention, is that the used spherical barium titanate has an average particle size, which is obtained from a scanning electron microscope, of a range from 0.05 μm to 0.7 μm, preferably from 0.1 μm to 0.5 μm. The size range is preferable because spherical barium titanate having an average particle size of less than 0.05 μm causes secondary aggregation with each other. There is thus a tendency to prevent a highly-dispersed product having a high sphericity from being produced. Meanwhile, when the average particle size exceeds 0.7 μm, the adhesion performance to toner resin declines. There is thus a tendency to reduce the intended effects of the present invention.

When the barium titanate is used as the external additive for toner in a form of monodispersed primary particles, the average particle size represents an average particle size of the primary particles of barium titanium themselves. When the barium titanate is used as the external additive for toner in a form of aggregates of fine primary particles, the average particle size represents an average particle size of the aggregates themselves.

In addition to the average particle size of the above-described range, it is particularly preferable that the external additive for toner according to the present invention have a content rate of particles having a size of 10 μm or greater of 10% by weight or less, preferably 5% by weight or less, thereby further enhancing the adhesion ratio of the barium titanate to the toner resin. A definition of the particle size herein is the same as that of the above-described average particle size.

In addition, it is preferable that the external additive for toner according to the present invention have a BET specific surface area of 3 $m^2/g$ to 20 $m^2/g$, preferably 4 $m^2/g$ to 15 $m^2/g$. It is particularly preferable that the BET specific surface area be within the range, in order to further enhance the adhesion performance to the toner resin.

The above-described external additive for toner according to the present invention may be produced by obtaining barium titanate basically in a wet method, such as a hydrothermal synthesis method, an alkoxide method, and the like; and then by heat-treating the barium titanate at a temperature of 400° C. to 1,000° C. It is preferable, however, that external additive for toner be produced in a first process, in which titanium hydroxide obtained from hydrolysis of titanium alkoxide by water, and a barium compound are reacted in a solvent containing water and alcohol, so as to obtain barium titanate (hereinafter referred to as a "spherical barium titanate precursor"); and subsequently, in a second process, in which the spherical barium titanate precursor is heat-treated at a temperature of 400° C. to 1,000° C., so as to obtain spherical barium titanate. The producing method is particularly preferable since the method provides, in particular, spherical barium titanate excellent in sphericity and surface roughness.

The producing method of the external additive for toner according to the present invention is explained below. The first process is to obtain a spherical barium titanate precursor, by reacting titanium hydroxide, which is obtained from hydrolysis of titanium alkoxide by water, and a barium compound in a solvent containing water and alcohol. In the first process, it is important to produce a spherical barium titanate precursor having excellent sphericity and surface roughness in particular. Using the spherical barium titanate precursor having excellent sphericity and surface roughness in the second process (described hereinafter) provides spherical barium titanate having particularly excellent sphericity and surface roughness.

The titanium hydroxide used in the first process is obtained by hydrolyzing titanium alkoxide by water. Examples used as the titanium alkoxide may include titanium methoxide, titanium ethoxide, titanium propoxide, titanium isopropoxide, titanium butoxide, and the like. Titanium butoxide is preferable for use among the above-listed substances, in view of easy industrial availability, good stability of the material itself, and physical properties, such as easy handling of separately formed butanol and the like. The titanium alkoxide may also be used in a form of a solution, in which the substance is dissolved in a solvent, such as alcohol, toluene, hexane, and the like. To hydrolyze titanium alkoxide by water, titanium alkoxide and water only need to be contacted following a common procedure. For instance, water is added to a solution containing titanium alkoxide. Water in the hydrolysis reaction is added in an amount at a mole ratio of twice or more with respect to titanium alkoxide, preferably at a mole ratio of twenty times or more. The hydrolysis is preferably performed at a temperature of 10° C. to 80° C., preferably 20° C. to 70° C.

Thereby, the hydrolysis of titanium alkoxide provides a suspension containing titanium hydroxide, alcohol, and water. In the present invention, the suspension can be used as it is, as one component of Solution A, which contains titanium hydroxide, alcohol, and water, in the first process (described hereinafter).

Subsequently, the titanium hydroxide obtained as above and a barium compound are reacted in a solvent containing water and alcohol. Examples used as the barium compound may include barium hydroxide, barium chloride, barium nitrate, barium acetate, barium alkoxide, and the like. Barium hydroxide is particularly preferable among the above-listed substances, since the substance has basicity that accelerates the reaction and it is inexpensive.

As the alcohol to be contained in the solvent containing water, one type, or two or more types, may be used from methanol, ethanol, propanol, isopropanol, butanol, and the like. It is preferable to use the same alcohol as alcohol secondarily produced along with titanium hydroxide in the hydrolysis of titanium alkoxide.

In the first process, it is preferable that titanium hydroxide and the barium compound be reacted in a solvent containing 10 to 400 parts by weight of alcohol, preferably 30 to 100 parts by weight, with respect to 100 parts by weight of water, in order to obtain a spherical barium titanate precursor having particularly excellent sphericity and surface roughness. Thus, it is particularly preferable that Solution B be added to Solution A in the reaction of the first process, such that 10 to 400 parts by weight of alcohol (A1), preferably 30 to 100 parts by weight, is provided with respect to 100 parts by weight of water (A2+B1), the Solution B containing the barium compound and water (B1), the Solution A containing the titanium hydroxide, which is obtained from the hydrolysis of titanium alkoxide by water, alcohol (A1), and water (A2). Thereby, a spherical barium titanate precursor having excellent sphericity and surface roughness is provided in an industrially advantageous manner. As described above, the suspension, which contains the titanium hydroxide obtained from the hydrolysis of titanium alkoxide by water, alcohol, and water, can be used as it is, as one component of Solution A used in the first process.

In the first process of the present invention, the formation reaction of the barium titanate precursor progresses at a pH of 10 or greater. Unless an alkaline compound, such as barium hydroxide or the like, is used as the barium compound, namely, when barium chloride, barium nitrate, barium acetate, or the like, for example, is used as the barium compound, it is preferable, after the barium compound is added to Solution A, to add an alkaline chemical for ordinary use, such as ammonia, sodium hydrate, and the like, to the reaction solution when necessary, in order to control the pH to 10 or greater, preferably 12 to 14.

As a reaction condition for the first process, it is preferable that the barium compound be added in an amount at a mole ratio of Ba in the barium compound with respect to Ti in a titanium compound (Ba/Ti) of 1.0 to 1.5, preferably 1.1 to 1.2, in order to easily control barium titanate in a stoichiometric ratio. Conversely, it is not preferable that the mole ratio be less than 1.0, since barium is insufficient with respect to the stoichiometric ratio; and that the mole ratio exceed 1.5, since a washing process is long, in which excessive barium with respect to the stoichiometric ratio is washed.

Further controlling reaction conditions, such as a reaction temperature, a temperature increase rate, and the like, for the reaction of the first process provides a spherical barium titanate precursor having a sharp particle size distribution, a desired average particle size, and excellent sphericity and surface roughness.

Specifically, the reaction in the first process of the present invention is performed at a reaction temperature of 10° C. to 100° C., preferably 20° C. to 90° C. In a temperature range from 10° C. to 60° C., preferably from 50° C. to 60° C., a fine barium titanate precursor is produced. When the temperature is gradually increased therefrom to a temperature of 80° C. to 100° C., and then the temperature is retained at 80° C. to 100° C. and the reaction is performed 0.5 to 24 hours, preferably 1 to 10 hours, a spherical aggregate of the fine barium titanate precursor is produced. For the temperature increase, it is preferable that a temperature increase rate be 5° C. to 50° C. per hour, preferably 10° C. to 30° C. per hour, in order to strike a balance between a process time and equipment load, and to provide spherical barium titanate having a sharp particle size distribution and excellent sphericity and surface roughness. After the reaction, a spherical barium titanium precursor can be obtained by solid-liquid separation, and washing when necessary.

The second process is to obtain spherical barium titanate, by heat-treating the spherical barium titanium precursor at a temperature of 400° C. to 1,000° C., preferably 600° C. to 900° C. In the second process of the present invention, the heating temperature range is specified as above because, when the heating temperature is less than 400° C., an organic material residue may remain in a wet process; and, when the heating temperature exceeds 1,000° C., the specific gravity, sphericity, and surface roughness of produced spherical barium titanate are adversely affected.

The heat treatment may be performed in an atmosphere or in an inert gas atmosphere, and not limited to a particular atmosphere. It is preferable that a heating duration be 2 to 30 hours, preferably 4 to 10 hours. In the present invention, the heat treatment may be performed as many times as desired, and may be performed while heating and grinding are repeated.

After the heating, spherical barium titanate can be obtained by cooling, and grinding and classification when necessary. The spherical barium titanate obtained as above has the following physical properties: an average particle size obtained from a scanning electron microscope of 0.05 μm to 0.7 μm, preferably 0.1 μm to 0.5 μm; a content of particles having a particle size of 1 μm or greater of 10% by weight or less, preferably 5% by weight or less; a BET specific surface area of 3 $m^2/g$ to 20 $m^2/g$, preferably 4 $m^2/g$ to 15 $m^2/g$; both a sphericity and a surface roughness of 1.0 to 1.4, preferably 1.0 to 1.3, and particularly preferably 1.0 to 1.25; and a specific gravity of 5.6 g/ml or less, preferably 5.5 g/ml or less, and particularly preferably 5.0 g/ml to 5.5 g/ml.

The external additive for toner according to the present invention can be used in an electrophotographic method that uses a magnetic single-component toner, a two-component toner, a non-magnetic toner, or the like. A producing method is not particularly limited, and a toner may be produced, for example, in a grinding method or a polymerization method. As binding resin for toner, publicly-known synthetic resin or natural resin may be used, including, for example, styrene resin, acrylic resin, olefin resin, diene resin, polyester resin, polyvinylchloride, maleic acid resin, polyvinyl acetate, polyvinyl butyral, rosin, terpene resin, xylene resin, polyamide resin, epoxy resin, silicone resin, phenol resin, petroleum resin, urethane resin, and the like. One type, or two or more types, from the above-listed substances may be used, and the binding resin for toner is not limited to the above-listed substances. Further, the toner may be added with additives in binding resin, the additives having conventionally been used in the toner field, including a charging regulator, a parting agent, magnetic powders, a colorant, a conductive additive, a lubricant, and the like.

The external additive according to the present invention can be used by adding to toner particles for 0.01% to 20% by weight, preferably 0.1% to 5% by weight. In addition, the external additive of the present invention can be used concurrently with another flow modifier. Examples of the another flow modifier may include inorganic powders, including hydrophobic silica, alumina, titanium oxide, cerium oxide, zirconium oxide, boron nitride, silicon carbide, and the like; and fine powders, including an aliphatic metal salt, polyvinylidene-fluoride, polyethylene, and the like. One type, or a combination of two or more types, from the above-listed substances may be used.

It is preferable that the external additive of the present invention be mixed with and added to (externally added to) the toner particles, such that a uniform mixture of toner particles and the external additive of the present invention is achieved. It is thus preferable that the external additive of the present invention be added to the toner particles for 0.01% to 20% by weight, preferably 0.1% to 5% by weight, and be mixed therewith uniformly by using a mixer, such as a Henschel mixer and the like.

Embodiments

The present invention is explained in detail below in the embodiments. The present invention, however, is not limited to the embodiments.

(Preparation of Barium Titanate Samples)

(Barium Titanate Sample 1-1)

(First Process: Preparation of a Spherical Barium Titanate Precursor)

In a dissolution tank having a Teflon® wetted portion, 700 parts by weight of purified water and 230 parts by weight of barium hydroxide octahydrate (Kanto Chemical Co., Inc.) as a reagent were charged, and heated while being stirred by a pitched-blade paddle impeller. Thereby, an aqueous solution having a temperature of 80° C. (Solution B) was prepared. In a reaction tank having a Teflon® wetted portion, 560 parts by weight of n-butanol (Kanto Chemical Co., Inc.) and 180 parts by weight of tetra-n-butoxytitanium (Wako Pure Chemical Industries, Ltd.) as a reagent were charged, and gradually added with 500 parts by weight of purified water for hydrolysis while being stirred by a pitched-blade paddle impeller. Thereby, a titanium hydroxide slurry having a temperature of 25° C. (Solution A) was prepared. When the barium hydroxide solution (Solution B) was immediately added to the titanium hydroxide slurry (Solution A), the temperature rose up to 50° C. While being refluxed, the solution was heated up to a temperature of 90° C. at a temperature increase rate of 15° C. per hour, and was further aged for 1 hour at a temperature of 90° C. After being cooled, the solution was filtered through a filter paper (5C) placed on a buchner funnel while being sucked by an aspirator, and thereby a crystallized cake of separated substances was obtained. The cake obtained from the separation was transferred to a washing tank having a Teflon® wetted portion. Then, 300 parts by weight of an acetate solution having a concentration of 2% to 4% was added. After washing and filtration were repeated twice, the obtained cake was dried for 24 hours at a temperature of 105° C., whereby spherical barium titanate precursor powder of the first process was produced.

(Second Process: Preparation of Spherical Barium Titanate)

The spherical barium titanium precursor powder obtained in the first process was crushed by a roll mill, charged in a mullite saggar, and then calcined at a temperature of 850° C. for 4 hours. Aggregates formed in the dry process through the heat treatment process were removed by a jet mill so as to use them as samples. A mole ratio of barium and titanium (Ba/Ti) of the obtained samples was 1.004 according to an X-ray fluorescence analysis. An electron microscope photograph of the obtained spherical barium titanate is shown in FIG. 1.

(Barium Titanate Sample 1-2)

(First Process: Preparation of a Spherical Barium Titanate Precursor)

In a dissolution tank having a Teflon® wetted portion, 600 parts by weight of purified water and 285 parts by weight of barium hydroxide octahydrate (Kanto Chemical Co., Inc.) as a reagent were charged, and heated while being stirred by a pitched-blade paddle impeller. Thereby, an aqueous solution having a temperature of 80° C. (Solution B) was prepared. In a reaction tank having a Teflon® wetted portion, 560 parts by weight of n-butanol (Kanto Chemical Co., Inc.) and 220 parts by weight of tetra-n-butoxytitanium (Wako Pure Chemical Industries, Ltd.) as a reagent were charged, and gradually added with 200 parts by weight of purified water for hydrolysis while being stirred by a pitched-blade paddle impeller. Thereby, a titanium hydroxide slurry having a temperature of 25° C. (Solution A) was prepared. When the barium hydroxide solution (Solution B) was immediately added to the titanium hydroxide slurry (Solution A), the temperature rose up to 50° C. While being refluxed, the solution was heated up to a temperature of 90° C. at a temperature increase rate of 30° C. per hour, and was further aged for 1 hour at a temperature of 90° C. After being cooled, the solution was filtered through a filter paper (5C) placed on a buchner funnel while being sucked by an aspirator, and thereby a crystallized cake of separated substances was obtained. The cake obtained from the separation was transferred to a washing tank having a Teflon® wetted portion. Then, 300 parts by weight of an acetate solution having a concentration of 2% to 4% was added. After washing and filtration were repeated twice, the obtained cake was dried for 24 hours at a temperature of 105° C., whereby spherical barium titanate precursor powder of the first process was produced.

(Second Process: Preparation of Spherical Barium Titanate)

The spherical barium titanium precursor powder obtained in the first process was crushed by a roll mill, charged in a mullite saggar, and then calcined at a temperature of 750° C. for 4 hours. Aggregates formed in the dry process through the heat treatment process were removed by a jet mill so as to use them as samples. A mole ratio of barium and titanium (Ba/Ti) of the obtained samples was 1.004 according to an X-ray fluorescence analysis. The obtained barium titanate was referred to as Sample 1-2.

(Barium Titanate Sample 1-3)

Barium titanate was obtained in a similar manner to the preparation of barium titanate Sample 1-2, except that the heat treatment of the second process was performed at a temperature of 650° C. for 4 hours.

(Barium Titanate Sample 2)

Barium titanate was obtained in a similar manner to the preparation of barium titanate Sample 1-1, except that the heat treatment of the second process was performed at a temperature of 1,050° C. for 4 hours.

(Barium Titanate Sample 3)

In a reaction tank having a Teflon® wetted portion, 720 parts by weight of purified water was put, and added with 106 parts by weight of barium carbonate (Kanto Chemical Co., Inc.) as a reagent while being stirred by a pitched-blade paddle impeller, and thereby a slurry was produced. In a preparation tank having a Teflon® wetted portion, 560 parts by weight of purified water was put, and added with 130 parts by weight of oxalic acid dehydrate (Kanto Chemical Co., Inc.) as a reagent while being stirred by a stir bar. Further, 256 parts by weight of an aqueous solution was added, the aqueous solution being obtained by diluting and controlling titanium tetrachloride (Osaka Titanium technologies Co., Ltd.) at a titanium oxide equivalent concentration of 15%. At this stage, a titanyl oxalate solution was obtained. While the barium carbonate slurry was maintained at a temperature of 25° C., the titanyl oxalate solution was added at a constant speed for a duration of 2 hours. After the addition, the solution was further stirred for 30 minutes. Then, the solution was filtered through a filter paper (5C) placed on a buchner funnel while being sucked by an aspirator, and thereby a cake of barium titanyl oxalate tetrahydrate separated in the reaction was obtained. The barium titanyl oxalate tetrahydrate cake was transferred to a washing tank having a Teflon® wetted portion. Then, 1,200 parts by weight of purified water was added and stirred, and repulp washing was performed for 30 minutes. The solution was filtered in a similar manner to the post-reaction process. Then, the obtained cake was dried at a temperature of 80° C. for 24 hours, whereby 215 parts by weight of dried powder of barium titanyl oxalate tetrahydrate was obtained. The obtained barium titanyl oxalate tetrahydrate had an average particle size of 12 μm, and a mole ratio of barium and titanium (Ba/Ti) was 1.003 according to an X-ray fluorescence analysis. The obtained barium titanyl oxalate tetrahydrate was charged in a mullite sagger, and deoxalated through air at a temperature of 800° C. for 20 hours. A BET specific surface area of the obtained powder was 7.05 $m^2/g$. After being crushed by a roll mill, the powder was charged back in the mullite sagger, and calcined at a temperature of 950° C. for 20 hours. Aggregates formed in the heat treatment process were removed by a jet mill so as to use them as samples.

(Barium Titanate Sample 4)

In a nylon pot, 1,100 parts by weight of zirconia balls having a diameter of 5 mm were put, and then 120 parts by weight of purified water, 0.1 part by weight of polycarboxylic ammonium, 42.4 parts by weight of barium carbonate (Kanto Chemical Co., Inc.) as a reagent, and 17.2 parts by weight of titanium oxide (Kojundo Chemical Laboratory Co., Ltd.) as a reagent were charged. After the pot was tightly closed, the media were ground and mixed at a speed of 100 rpm for a duration of 24 hours. The contents of the pot were transferred to a vat and dried at a temperature of 105° C. for 24 hours. The substances were then separated from the balls using a 300 μm sieve, whereby mixed powder was obtained. The powder was charged in a mullite sagger, and calcined at a temperature of 950° C. for 20 hours. Aggregates formed in the heat treatment process were removed by a jet mill so as to use them as samples.

(Evaluation of Barium Titanate Properties)

(Granularity Characteristics)

An average particle size was obtained as an average value from a scanning electron microscope photograph of randomly sampled 1,000 particles. A content of particles having a size of 1 μm or greater was obtained by using a Microtrac laser grading analysis instrument.

(Specific Surface Area)

The specific surface area was measured in a common method using a BET method monosorb specific surface area measurement device.

(Shape Factor)

The shape factor was calculated from parameters, which were obtained from image analysis of randomly sampled 100 particles using an image analyzing device Luzex AP (Nireco Corporation). The sphericity was obtained as an average value from a calculation of (Perfect circle area formed by a maximum diameter)/(Actual surface area). The surface roughness was obtained as an average value from a calculation of (Perfect circle area that forms a boundary length)/(Actual surface area).

(Specific Gravity)

The specific gravity was measured at normal temperature (25° C.) with a liquid phase as ethanol, using an automatic specific gravity measuring device MAT-7000 (Seishin Enterprise Co., Ltd.), which measures specific gravity based on a principle of a liquid phase substitution method.

TABLE 1

| Barium titanate sample | SEM average particle size (μm) | BET specific surface area ($m^2/g$) | Content of particles of 1 μm or more (% by weight) | Sphericity | Surface roughness | Specific gravity |
|---|---|---|---|---|---|---|
| Sample 1-1 | 0.34 | 4.42 | 0 | 1.23 | 1.17 | 5.30 |
| Sample 1-2 | 0.15 | 12.09 | 0 | 1.36 | 1.30 | 5.43 |
| Sample 1-3 | 0.15 | 12.13 | 0 | 1.30 | 1.25 | 5.39 |
| Sample 2 | 0.66 | 2.60 | 45.2 | 1.60 | 1.39 | 5.90 |
| Sample 3 | 0.33 | 4.52 | 10.6 | 1.50 | 1.36 | 5.84 |
| Sample 4 | 0.39 | 4.04 | 22.9 | 1.50 | 1.40 | 5.83 |

Examples 1 to 3 and Comparative Examples 1 to 4

Evaluation as an External Additive for Toner (Preparation of Toners)

Polyester resin (Mn: 4300; Mw: 42000; Acid number: 6 mg KOH/g; Tg: 61° C.), carbon black (Product name: Cabot Regal 330), 1 part by weight of metal containing dye (Product name: Orient Chemical Bontron E-84), and 2 parts by weight of low-molecular-weight polypropylene (Product name: Sanyo Chemical Biscol 660P) were mixed using a Henschel mixer and were kneaded using a twin-screw kneading extruder, of which a cylinder temperature was set to 160° C. After being cooled, the obtained mixture was ground by a fine grinding mill using a jet mill, and was classified using an air current separator. Thereby, toner particles having an average particle size of 9 μm were obtained. Subsequently, 100 parts by weight of the toner particles obtained as above, 0.6 part by weight of hydrophobic silica (Product name: Nippon Aerosil R-972), and 1 part by weight of each of the barium titanate samples prepared as above were fully mixed using a Henschel mixer, and then were filtered through a 100 mesh sieve. Thereby, respective toner samples were obtained. A toner with no barium titanate added was prepared as Comparative example 4. Using the toner samples, test patterns were printed using a commercially available laser printer. Then, the 1,000$^{th}$ printout was evaluated for image density using a Macbeth densitometer and for background fog and black uniformity with a visual check. The background fog and black uniformity were evaluated as below.

Background Fog Evaluation

○: No fog

Δ: Slight fog

X: Significant fog

Black Uniformity Evaluation

○: No density unevenness

Δ: Slight density unevenness

X: Significant density unevenness

The evaluation results are shown in Table 2.

TABLE 2

| | Barium titanate sample type | Image density | Background fog evaluation | Black uniformity evaluation |
|---|---|---|---|---|
| Example 1 | Sample 1-1 | 1.47 | ○ | ○ |
| Example 2 | Sample 1-2 | 1.46 | ○ | ○ |
| Example 3 | Sample 1-3 | 1.45 | ○ | ○ |
| Comparative example 1 | Sample 2 | 1.39 | X | X |
| Comparative example 2 | Sample 3 | 1.42 | Δ | X |
| Comparative example 3 | Sample 4 | 1.39 | Δ | X |
| Comparative example 4 | — | 1.33 | X | X |

The results shown in Table 2 demonstrated that the printer that used toners externally added with the barium titanate according to the present invention concurrently achieved high image density and reduced background fog, and further achieved improvements in all image defects, such as void, fading, and the like, compared to the comparative examples.

Blending the barium titanate external additive of the present invention in a toner enhances, in particular, the toner fluidity, electrical properties, and other relevant performance; concurrently achieves high image density and reduced background fog; and further reduces image defects, such as void, fading, and the like.

What is claimed is:

1. An external additive for toner comprising spherical barium titanate having a specific gravity of 5.6 g/ml or less, a sphericity of 1.0 to 1.4, and a content of particles having a particle size of 1 μm or greater of 10% by weight or less.

2. The external additive for toner according to claim 1, wherein the spherical barium titanate has a surface roughness of 1.0 to 1.4.

3. The external additive for toner according to claim 1, wherein the spherical barium titanate has an average particle size of 0.05 μm to 0.7 μm.

4. A method of producing an external additive for toner, comprising:

reacting titanium hydroxide, which is obtained from hydrolysis of titanium alkoxide by water, and a barium compound in a solvent comprising water and alcohol to form a reaction product; and heat-treating the reaction product at a temperature of 400° C. to 1,000° C., so as to obtain spherical barium titanate having a specific gravity of 5.6 g/ml or less, a sphericity of 1.0 to 1.4, and a content of particles having a particle size of 1 μm or greater of 10% by weight or less.

5. The method of producing an external additive for toner according to claim 4, wherein the solvent comprising water and alcohol comprises 10 to 400 parts by weight of alcohol with respect to 100 parts by weight of water.

6. The external additive for toner according to claim 2, wherein the spherical barium titanate has an average particle size of 0.05 μm to 0.7 μm.

7. The external additive for toner according to claim 1, wherein the barium titanate is obtained by:

reacting titanium hydroxide, which is obtained from hydrolysis of titanium alkoxide by water, and a barium compound in a solvent comprising water and alcohol to form a reaction product; and heat-treating the reaction product at a temperature of 400° C.-1,000° C., so as to obtain spherical barium titanate.

* * * * *